US009533341B2

(12) United States Patent
Ikeda et al.

(10) Patent No.: US 9,533,341 B2
(45) Date of Patent: Jan. 3, 2017

(54) ROLLER HEMMING PROCESSING SYSTEM

(75) Inventors: Hitoshi Ikeda, Ebina (JP); Eiichi Nara, Yokohama (JP)

(73) Assignee: NISSAN MOTOR CO., LTD., Yokohama-Shi (JP)

( * ) Notice: Subject to any disclaimer, the term of this patent is extended or adjusted under 35 U.S.C. 154(b) by 643 days.

(21) Appl. No.: 13/518,970

(22) PCT Filed: Sep. 13, 2011

(86) PCT No.: PCT/JP2011/070835

§ 371 (c)(1),
(2), (4) Date: Jun. 25, 2012

(87) PCT Pub. No.: WO2012/039320

PCT Pub. Date: Mar. 29, 2012

(65) Prior Publication Data

US 2012/0260711 A1 Oct. 18, 2012

(30) Foreign Application Priority Data

Sep. 24, 2010 (JP) ..... 2010-213084

(51) Int. Cl.
*B21D 39/02* (2006.01)
*B21D 37/14* (2006.01)

(52) U.S. Cl.
CPC ..... *B21D 39/021* (2013.01); *B21D 37/145* (2013.01); *B21D 37/147* (2013.01); *B21D 39/023* (2013.01)

(58) Field of Classification Search
CPC ..... B21D 37/04; B21D 37/14; B21D 39/00; B21D 39/02; B21D 39/021; B21D 39/023; B21D 37/146; B21D 37/06; B21D 37/145; B21D 37/147; B21J 13/00; B21J 13/085; B21J 13/08; B65G 1/02; B65G 1/023;B65G 1/026; B23Q 3/155–3/15793; A47F 7/0042; Y10T 483/17; B21B 31/02; B21B 31/08; B21B 31/10; B21B 31/12; B21B 31/14; B21B 21/00; B21B 21/005; B21B 21/04; B21B 21/045; B21B 1/30; B30B 15/026; B30B 15/028; B30B 15/0029; B30B 15/0035; B30B 15/0041; B30B 15/14; B30B 15/16
(Continued)

(56) References Cited

U.S. PATENT DOCUMENTS 2,647,784 A * 8/1953 Janiszewski ..... 294/131
4,151,736 A * 5/1979 Quaas ..... 72/446
(Continued)

FOREIGN PATENT DOCUMENTS

EP 1 092 486 A2 4/2001
JP 04-037423 A 2/1992
(Continued)

*Primary Examiner* — Jimmy T Nguyen
*Assistant Examiner* — Gregory Swiatocha
(74) *Attorney, Agent, or Firm* — Foley & Lardner LLP

(57) ABSTRACT

Hemming dies can be mounted on the respective two clamping jigs (22) of hemming processing stages (S1, S2) each having a turn table as a main part. After the hemming dies are allocated to sub-stages (S11), roller hemming processing is performed by hemming processing robots (1A, 1B) or hemming processing robots (2A, 26). Die storage devices (15A, 15B) for housing a plurality of hemming dies in a line are provided near the hemming processing stages (S1, S2). Hemming dies are changed between the die storage devices (15A, 15B) and the sub-stages (S12) of the hemming processing stages (S1, S2) by first and second die changing robots (17, 19). This makes it possible to provide a roller hemming processing system suitable for roller hemming processing in high-variety low-volume manufacturing.

14 Claims, 11 Drawing Sheets

(58) Field of Classification Search
USPC ..... 72/252.5, 237–239, 446–448, 214, 220; 483/29, 16, 58, 60, 61, 62; 414/266, 267; 211/41.14, 41.15
See application file for complete search history.

(56) References Cited

U.S. PATENT DOCUMENTS

| | | | | | |
|---|---|---|---|---|---|
| 5,203,073 | A * | 4/1993 | Kotake et al. | 29/784 | |
| 5,410,904 | A * | 5/1995 | Hirata | B21D 5/002 | 483/28 |
| 5,755,653 | A * | 5/1998 | Nishida | 483/1 | |
| 6,112,390 | A * | 9/2000 | Takeda et al. | 29/33 K | |
| 6,324,880 | B1 * | 12/2001 | Nakamura | B21D 39/021 | 29/243.58 |
| 6,421,893 | B1 * | 7/2002 | Katayama et al. | 29/33 K | |
| 6,619,096 | B1 * | 9/2003 | Hartley et al. | 72/316 | |
| 2002/0170333 | A1 * | 11/2002 | Saint Denis et al. | 72/312 | |
| 2005/0044700 | A1 * | 3/2005 | Ghuman et al. | 29/791 | |
| 2008/0256779 | A1 * | 10/2008 | Ryu | B21D 39/021 | 29/505 |
| 2009/0089995 | A1 * | 4/2009 | Toeniskoetter et al. | 29/463 | |
| 2010/0154503 | A1 * | 6/2010 | Hasegawa | B21D 19/04 | 72/199 |
| 2013/0310236 | A1 * | 11/2013 | Kojima et al. | 483/28 | |

FOREIGN PATENT DOCUMENTS

| | | | |
|---|---|---|---|
| JP | 05-023763 | A | 2/1993 |
| JP | 2003-225721 | A | 8/2003 |
| JP | 2004-216404 | A | 8/2004 |
| JP | 2007-210005 | A | 8/2007 |
| JP | 2008-264824 | A | 11/2008 |

* cited by examiner

ROLLER HEMMING PROCESSING SYSTEM

This application claims priority from Japanese Patent Application 2010-213084, filed Sep. 24, 2010, which is incorporated herein by reference in its entirety.

TECHNICAL FIELD

This invention relates to a roller hemming processing system, and more specifically to a roller hemming processing system in which used hemming dies are exchangeable in accordance with a type of a workpiece when a hemming processing is performed to the workpiece by a roller hemming processing tool which is held by a robot arm.

BACKGROUND ART

In a patent document 1 and so on, there is known a hemming processing performed by a roller-shaped hemming processing tool held by a robot arm, in addition to a conventional press-type hemming processing by upper and lower dies. On the premise of the press-type hemming processing, there have been proposed hemming processing systems in which tooling change operation of upper and lower dies according to the change of the kind of the workpiece is effectively performed, and which are suitable for high-variety low-volume manufacturing (low volume production of a wide variety of products), in patent documents 2 and 3. Similarly, on the premise of the above-described roller hemming processing, there has been proposed a hemming processing system in which the tolling change operation of the lower die according to the change of the kind of the workpiece is effectively performed, and which is suitable for the high-variety low-volume manufacturing, in a patent document 4.

In the systems described in the patent documents 2 and 3, a set of the upper and lower dies are changed by using truck (carriage) type and other conveying apparatuses, between a press machine and a storage area in which the sets of the upper and lower dies according to the kind of the workpiece are stored.

Moreover, in the system described in the patent document 4, a mounting table for the lower die is prepared near the processing stage. Furthermore, a plurality of sets in which each of lower dies that are different in accordance with the kind of the workpiece is mounted on a common general-purpose jig irrespective of the kinds (types) of the workpiece are prepared, and these are stored on the mounting table for the lower die. Then, when the kind of the workpiece are changed, the lower die and also the general-purpose jig are changed between the processing stage and the mounting table for the lower die by using forklift and so on.

However, in the conventional processing systems described in the patent documents 2 and 3, it is necessary to store a plurality of kinds of upper and lower dies having weights from several tons to several dozen tons in the horizontal manner in a storage area. Accordingly, the occupied area of the storage area necessarily becomes large, so that the space efficiency is deteriorated. Moreover, since the set of the upper and lower dies having the weight from several tons to several dozen tons is changed, the operation of the die change is complicated, the time necessary for the die change is necessarily lengthened, and an actual operation availability (availability factor) of the press machine is deteriorated. Therefore, it is not preferable.

Moreover, in the conventional processing system described in the patent document 4, the change operation of the lower die mounted on the general-purpose jig is performed by the forklift and so on. Accordingly, the change operation of the lower die requires time due to the operation of handling the heavy member, though not to the extent of the time necessary for the change of the set of the upper and lower dies. Therefore, it is not efficient. Moreover, there is a restriction of the number of the lower dies which are stored in the mounting table for the lower die. Accordingly, it is not possible to respond to the high-variety low-volume manufacturing in which the kinds of the workpiece that is the processed object are further increased. For example, in a case where it responds to the respective hemming processings of a front door and a rear door of a plurality of types of the vehicle, like the hemming processing of the door of the vehicle, the number of the lower dies to be stored is necessarily increased. Moreover, the identification of the type of the lower die to be selected and the position of the lower die within the mounting table for the lower die depend on the operator. It is not possible to flexibly respond to the change operation of the lower dies to be frequently performed. Moreover, it needs the larger space for storing the many lower dies each of which has a weight from a few hundred kilograms to several tons, as the kinds of the prepared lower dies are increased. The space efficiency is deteriorated due to the increase of the occupied area for storing the lower dies.

PRIOR ART DOCUMENT

Patent Document

Patent Document 1: Japanese Patent Application Publication No. 5-23763

Patent Document 2: Japanese Patent Application Publication No. 4-37423

Patent Document 3: Japanese Patent Application Publication No. 2004-216404

Patent Document 4: Japanese Patent Application Publication No. 2003-225721

SUMMARY OF THE INVENTION

The present invention provides a roller hemming processing system which is capable of flexibly responding by automatic change of dies even in a case of high-variety low-volume manufacturing in which kinds of the workpiece that is a processed object are further increased.

The present invention is a roller hemming processing system in which a used hemming die can be changed in accordance with a type of a workpiece when a hemming processing is performed on a peripheral portion of the workpiece by a roller-shaped hemming processing tool which is held by a robot arm while the workpiece that is a processed object is positioned and supported on the hemming die. The roller hemming processing system includes: the hemming die in which a die body is mounted to a die plate for reinforcement, a clamping jig which is disposed on a hemming processing stage, and which is capable of removably positioning and fixing the hemming die; a die storage device in which a plurality of kinds of the hemming dies according to the type of the workpiece are received in a line in a longitudinal posture; a die changing robot which changes the hemming die between the clamping jig and the die storage device by swingably grasping the hemming die; and guide portions which are provided, respectively, to the clamping jig and the die storage device, and which restrict a posture of the hemming die loaded to the clamping jig or the die storage device.

Accordingly, in this system, when the type of the workpiece that is the processed object is changed, the type information of the workpiece and also the change command of the hemming die is loaded to the die changing robot. When the die changing robot receives this change command, in a case where the hemming die exists on the clamping jig of the hemming processing stage, the die changing robot unloads the existing hemming die, and returns the hemming die to the initial position of the die storage device. Moreover, the die changing robot takes out (unloads) the predetermined hemming die according to the type information of the workpiece, and sets that on the clamping jig of the hemming processing stage. With this, it is possible to perform the new hemming processing in accordance with the change of the type of the workpiece.

By the present invention, it is possible to effectively perform the change operation of the hemming die in accordance with the change of the type of the workpiece that is the processed object. Accordingly, even in the high-variety low-volume manufacturing in which the kinds of the workpiece that is the processed object are further increased, it is possible to reasonably and flexibly respond, and to improve the productivity. In particular, the plurality of kinds of the hemming dies are received in a line in the longitudinal posture in the die storage device. Accordingly, the occupied space for storing the hemming dies is small with respect to the number of the stored hemming dies. It is superior in the space efficiency.

BRIEF DESCRIPTION OF DRAWINGS

FIG. 1 is an explanatory plan view showing a schematic structure of an overall system.

FIG. 2(A) is an explanatory view showing a principle of a pre-hemming processing. FIG. 2(B) is an explanatory view showing a principle of a final-hemming processing.

DESCRIPTION OF EMBODIMENTS

Figure 1:
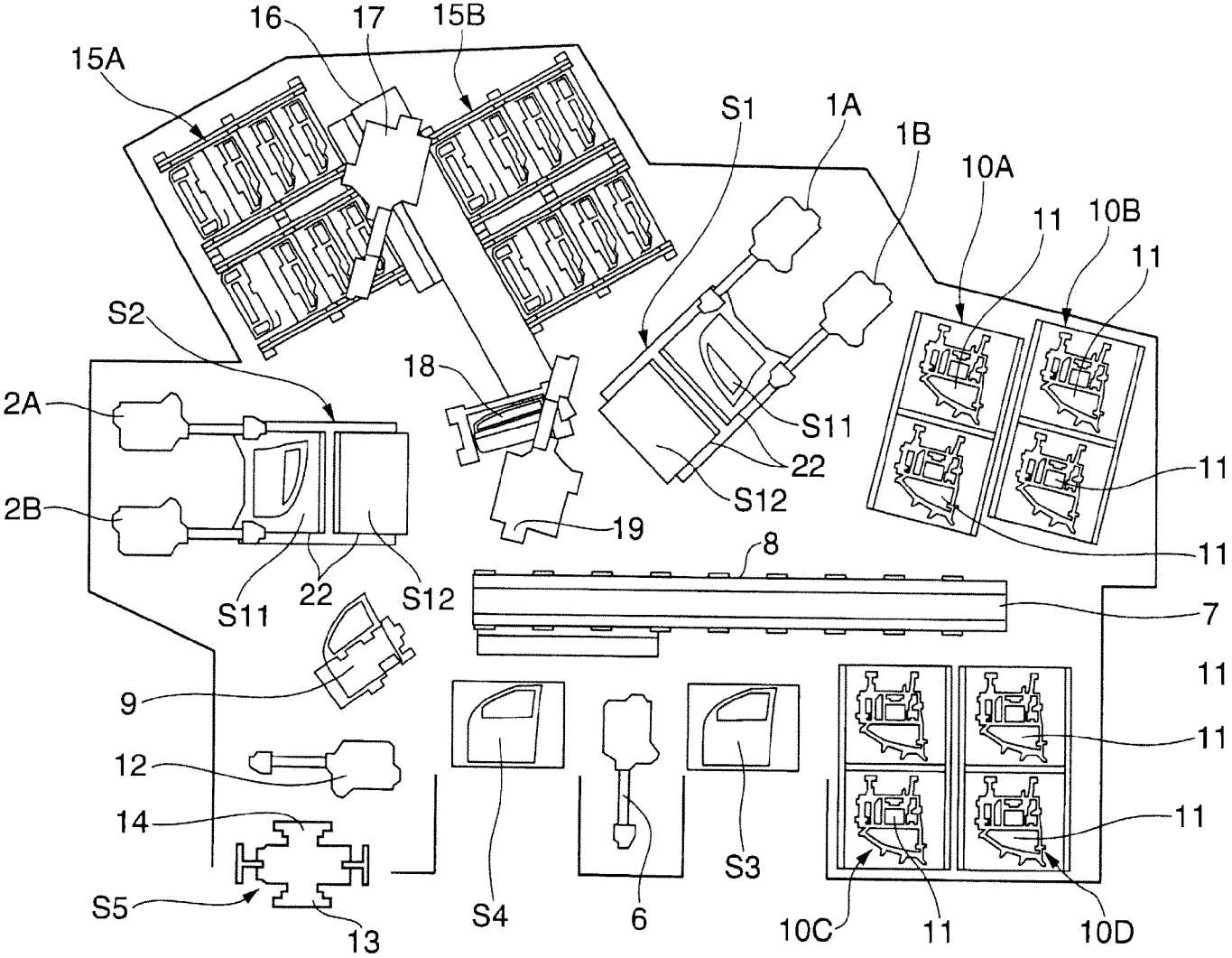
FIG. 1 is a view showing an embodiment of a roller hemming processing system according to the present invention.

FIG. 1 is a schematically explanatory plan view showing the entirety of a hemming processing system according to the present invention. In this case, it shows an example in which the present invention is applied to the hemming processing for a door panel (a front door panel or a rear door panel) of a vehicle which is constituted by hemming between a door outer panel and a door inner panel.

Figure 2:
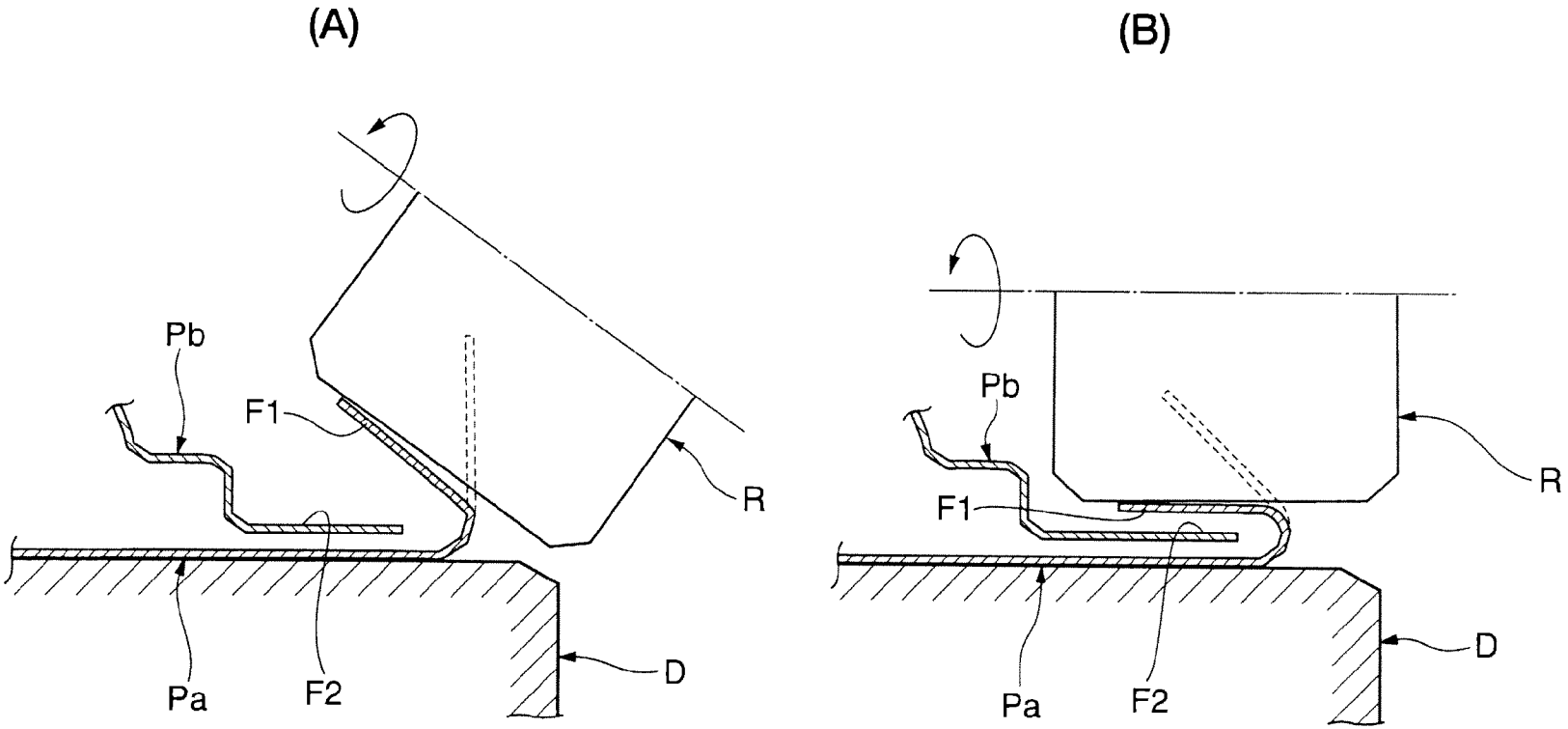
FIGS. 2(A) and 2(B) are explanatory views of a processing configuration of the roller hemming processing.

The roller hemming processing of the door panel includes both of a pre-hemming processing (pre-bending) and a final-hemming processing (final-bending). In the pre-hemming processing, a hemming flange portion F1 of a door outer panel Pa is bent substantially 45 degrees toward a hemming flange portion F2 of a door inner panel Pb by using a hemming roller R which is a roller-shaped hemming processing tool after a hemming die D, the door outer panel Pa and the door inner panel Pb are relatively positioned since the hemming flange portion F1 is previously formed around a periphery of the door outer panel Pa which will be connected with the door inner panel Pb by the hemming, as shown in FIG. 2(A). In the final-hemming processing, the hemming flange portion F1 after the pre-hemming processing is bent to be superimposed on the hemming flange portion F2 of the door inner panel Pb so that the hemming flange portions F1 and F2 are connected with each other by the hemming, as shown in FIG. 2(*b*).

In the hemming processing system of FIG. 1, there are provided two hemming processing stages S1 and S2 having, as main parts (bases), turn tables 21 (cf. FIGS. 5-7) described later. The hemming processing of the door panel is alternately performed on these two hemming processing stages S1 and S2. Moreover, each of the hemming processing stages S1 and S2 include a sub stage S12 for setting and removing a workpiece, and for change (tolling change) of the hemming die, and a sub stage S11 as an actual processing stage on which the hemming processing (including the pre-hemming processing and the final-hemming processing described above) is actually performed. Two hemming processing robots 1A and 1B or 2A and 2B arranged to perform the hemming processing are disposed on each of the sub stages S11. Each of the two hemming processing stages S1 and S2 which are constituted to employ the turn tables as the main parts is provided with a pair of clamping (supporting) jigs 22 (shown in FIGS. 5-7) on which a hemming die 27 described later (shown in FIG. 8) is removably positioned and fixed.

Figure 3:
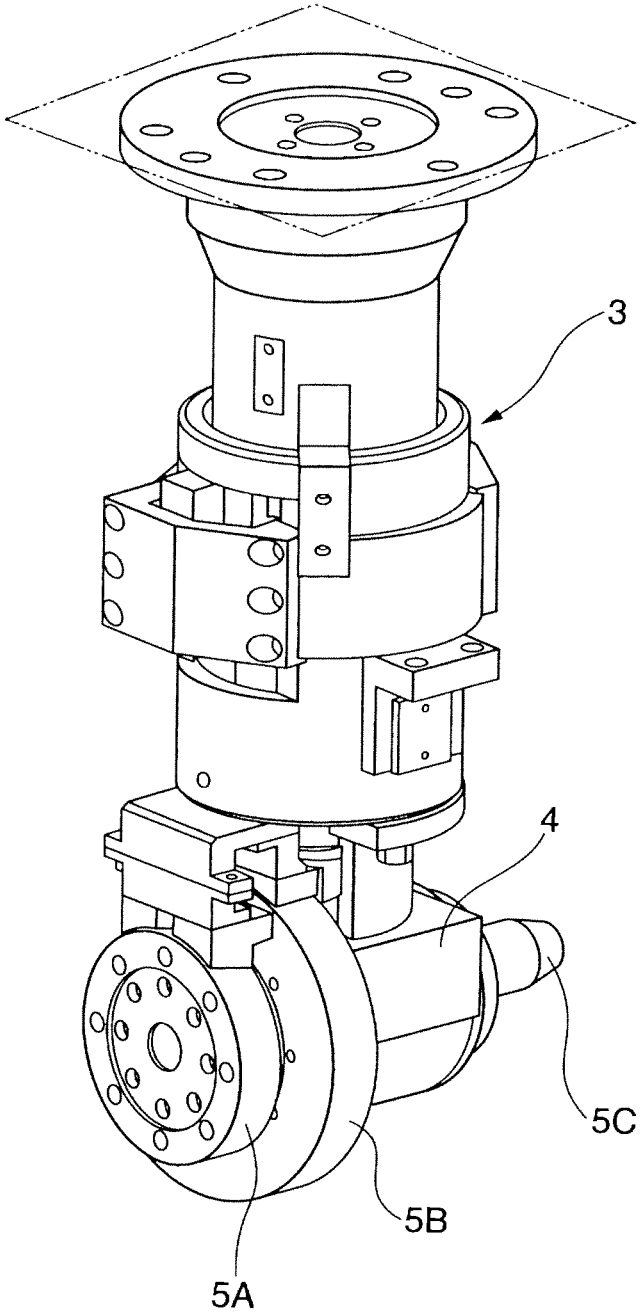
FIG. 3 is a perspective view showing a main part of a tool unit mounted to a hemming processing robot.
Figure 4:
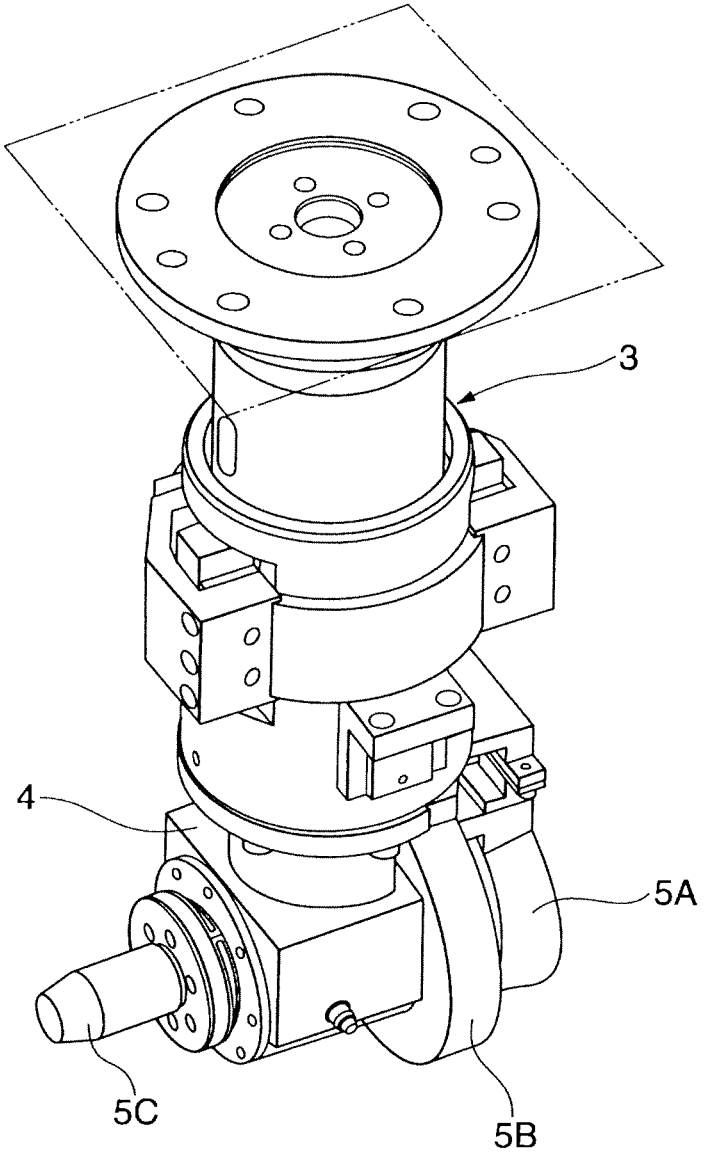
FIG. 4 is a perspective view showing the main part of the tool unit as viewed in another direction different from FIG. 3.

A tool unit 3 shown in FIGS. 3 and 4 is provided at a tip end of an arm of each of the hemming processing robots 1A and 1B or 2A and 2B. At a holder 4 of the tool unit 3, there are provided three kinds of hemming rollers 5A, 5B, and 5C which are the roller-shaped hemming processing tools, which have different diameters, which are rotatable, and which are provided coaxially with each other. The hemming processing shown in FIG. 2 is performed by selectively using these three kinds of the hemming rollers 5A, 5B, and 5C. Besides, these hemming rollers 5A, 5B, and 5C correspond to the hemming roller R of FIG. 2.

The hemming processing stages S1 and S2 of FIG. 1 are provided, respectively, with panel loading stages S3 and S4 for the door outer panel and the door inner panel. A sealing robot 6 is disposed so as to be shared by both of the panel loading stages S3 and S4. When the door outer panel is set by an operator on a predetermined jig of the panel loading stage S3 or S4, the sealing robot 6 is started up. The sealing robot 6 applies an anticorrosive sealant and a mastic material to a joint surface of the door outer panel set on the panel loading stage S3 or S4, with the door inner panel. After the sealing operation by the sealing robot 6 is finished, the operator sets the door inner panel again so as to be superimposed on the door outer panel. With this, a door panel assembly to be loaded to the hemming processing stages S1 and S2, that is, one set of the door outer panel and the door inner panel are temporarily assembled.

Moreover, between the hemming processing stages S1 and S2 and the panel loading stages S3 and S4 in FIG. 1, there is prepared a panel handling robot 8 which is capable of running on a guide rail 7 in a traverse direction, that is, which has a traveling shaft. This panel handling robot 8 has a function to load (put) the above-described door panel assembly from the panel loading stage S3 to the sub stage S12 of the hemming processing stage S1, and similarly from the another panel loading stage S4 to the sub stage S12 of the hemming processing stage S2. At the same time, the panel handling robot 8 has a function to carry (discharge) the door panel out after the hemming processing, from the sub stage S12 of the hemming processing stage S1 to a temporarily mounting table 9 described later, and from the sub stage S12 of the another hemming processing stage S2 to the temporarily mounting table 9.

The panel handling robot 8 is provided with hand storage devices 10A-10D disposed on both sides of the guide rail 7 to sandwich the guide rail 7. A plurality of hands 11 for the panel handling are previously stored, and stands by in the hand storage devices 10A-10D. The plurality of hands 11 have shapes and specifications which are different in accordance with types of the door panel (the type of the vehicle). During a predetermined operation on the panel loading stage S3 or S4, the panel handling robot 8 selects the hand 11 corresponding to the type of the vehicle, from the hand storage devices 10A-10D, and the panel handling robot 8 stands by while the panel handling robot 8 autonomously mounts the hand 11 at a wrist portion at a tip end of the arm. Then, the panel handling robot 8 waits the end of the operation on the panel loading stage S3 or S4, the panel handling robot 8 grasps, by that hand 11, the door panel assembly on the panel loading stage S3 or S4, and loads (puts) that to a hemming die 27 on the sub stage S12 of the hemming processing stage S1 or S2.

In this case, the hand 11 itself performs the relative positioning between the door outer panel and the door inner panel of the door panel assembly grasped by the hand 11 of the panel handling robot 8. Accordingly, the panel handling robot 8 separates the hand 11 from the wrist portion, and loads and positions the door panel assembly constituted by the door inner panel and the door outer panel which are positioned relative to each other by that hand 11, and also that hand 11 itself, to the hemming die 27 on the sub stage S12 of the hemming processing stage S1 or S2.

When, in this way, the door panel assembly is loaded and positioned by the panel handling robot 8 on the hemming die 27 on the sub stage S12 of the hemming processing stage S1 or S2, the door panel assembly of the sub stage S12 is indexed (allocated) and positioned with the hemming die 27 on the sub stage S11, by the indexing rotation of the turn table 22 which is a main part (base) of the sub stage S12 of the hemming processing stage S1 or S2. Then, on the sub stage S11, a pair of the two hemming processing robots 1A and 1B or 2A and 2B having the tool unit 3 shown in FIGS. 3 and 4 is started up, and the hemming processing shown in FIG. 2 is performed by the tool unit 3 shown in FIGS. 3 and 4, by the coordinated operation of the pair of the two hemming processing robots 1A and 1B or 2A and 2B. With this, the door panel assembly is varied to the door panel which is the rigid body that is formed by jointing the peripheries of the door outer panel and the door inner panel by the hemming.

After finishing the hemming processing by the pair of the two hemming processing robots 1A and 1B or 2A and 2B, the hemming processing robots 1A and 1B or 2A and 2B stand by at the origin position. When a command to change the hemming die 27 in accordance with the change of the type of the vehicle of the door panel of the object to which the hemming processing is performed is outputted in preparation for the next cycle as described later, the changing operation of the hemming die 27 is performed on the sub stage S12 of the hemming processing stage S1 or S2 of FIG. 1.

After finishing the hemming processing on the sub stage S11 of the hemming processing stage S1 or S2, the door panel after the hemming processing is indexed to the sub stage S12, discharged again by the panel handling robot 8, and transferred in a backward tilting posture to the temporarily mounting table 9 of FIG. 1. The door panel transferred to the temporarily mounting table 9 is further transferred in an upright posture by an unloading robot 12, to a reverse jig (inversion jig) 13 or 14 of a door panel discharge stage S5. On this door panel discharge stage S5, the pair of two reverse jigs 13 and 14 is rotatable about a vertical axis at each 180 degrees. When the reverse operation of the pair of the two reverse jigs 13 and 14 is performed, the door panel after the hemming processing is unloaded by the operator at each reverse operation.

Figure 10:
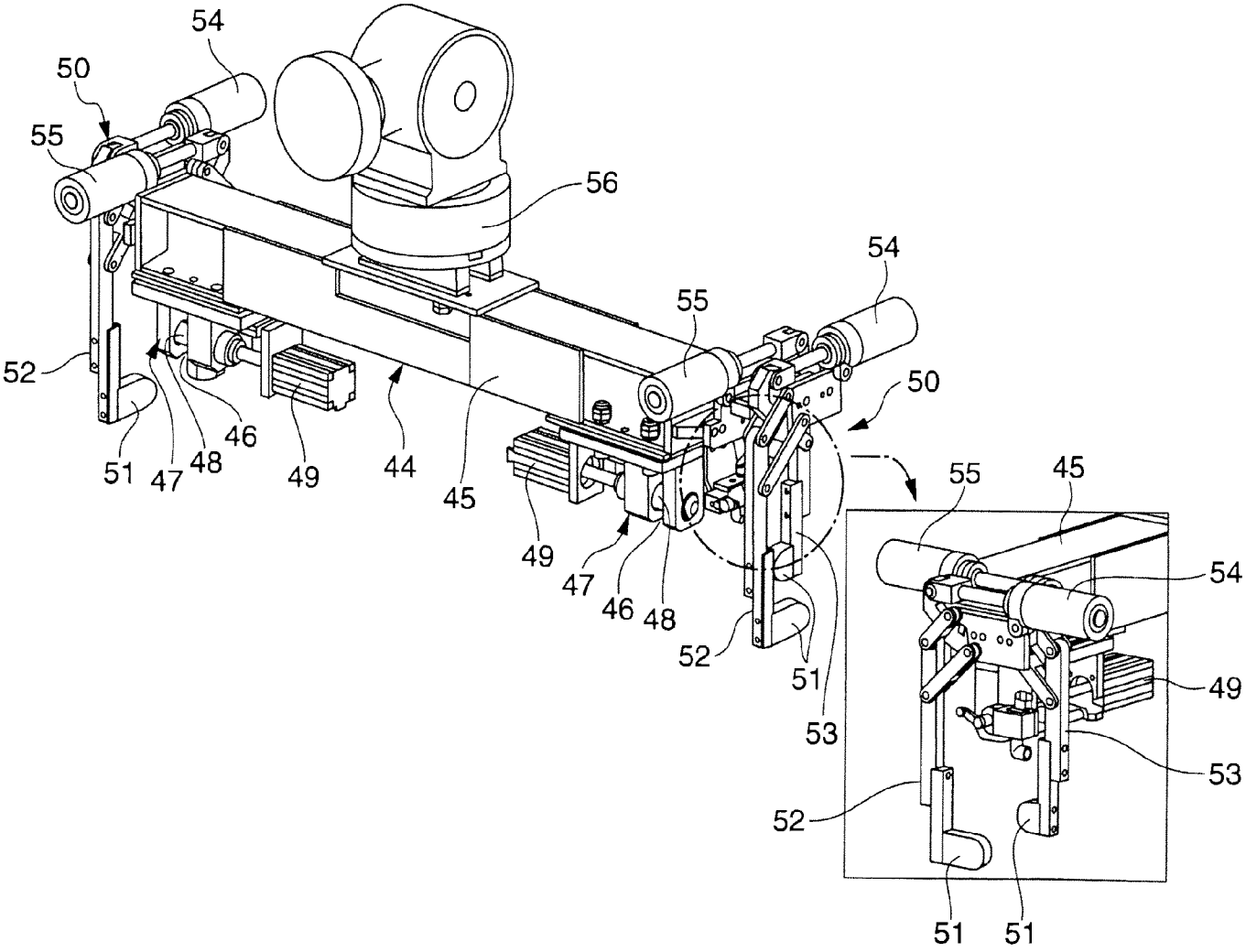
FIG. 10 is a perspective view showing a main part of a die changing hand mounted to first and second die changing robots.

In this case, as described above, the die storage devices 15A and 15B are disposed adjacent to the respective hemming processing stages S1 and S2. Moreover, a first die changing robot 17 is disposed between the die storage devices 15A and 15B. The first die changing robot 17 is shared by the both of die storage devices 15A and 15B. The first die changing robot 17 is capable of running in the transverse direction on a guide rail 16, that is, has a traveling shaft. Moreover, a temporarily mounting table 18 and a second die changing robot 19 are disposed between the both of hemming processing stages S1 and S2. The temporarily mounting table 18 and the second die changing robot 19 are shared by the both of the hemming processing stages S1 and S2. Besides, common die changing hands 44 (described later) shown in FIG. 10 are provided at tip ends of arms of the first and second changing robots 17 and 19.

Then, when a change command of the hemming die 27 according to the change of the type of the vehicle of the door panel to which the hemming processing is performed is outputted, the second die changing robot 19 is started up. The second die changing robot 19 removes (unloads) the hemming die 27 from the sub stage S12 of the hemming processing stage S1 or S2 in the rest condition, and transfers that to the temporarily mounting table 18. The hemming die 27 transferred to the temporarily mounting table 18 is unloaded by the first die changing robot 17, and returned to a free area of the die storage devices 15A and 15B. On the other hand, first die changing robot 17 takes (retrieves) a new hemming die 27 which corresponds to the changing command, out of (from) one of the areas of the storage devices 15A and 15B, and transfers that to the temporarily mounting table 18. Then, the hemming die 27 transferred to the temporarily mounting table 18 is unloaded by the second die changing robot 19, and loaded to and set on the sub stage S12 of the hemming processing stage S1 or S2 in the rest condition from which the hemming die 27 was just unloaded. In this way, the change (replacement) of the hemming die 27 according to the change of the type of the vehicle of the door panel that is an object to which the hemming processing is performed is finished.

Besides, the details of the clamping jigs 22 and the hemming dies 27 itself of the hemming processing stages S1 and S2, and the details of the die storage devices 15A and 15B and the die changing hand 44 will be explained later.

Figure 5:
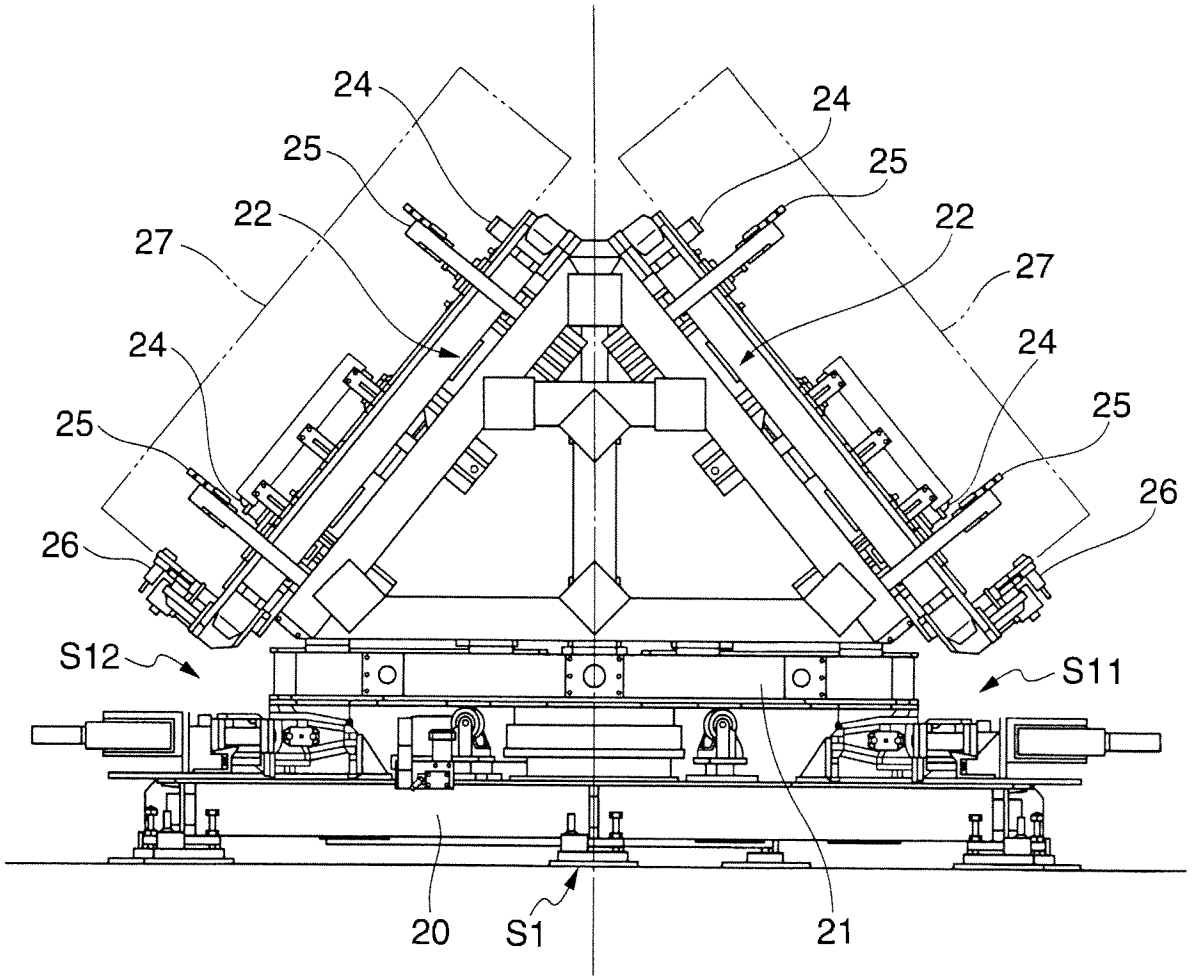
FIG. 5 is an explanatory front view showing a clamping jig on a hemming processing stage shown in FIG. 1.
Figure 6:
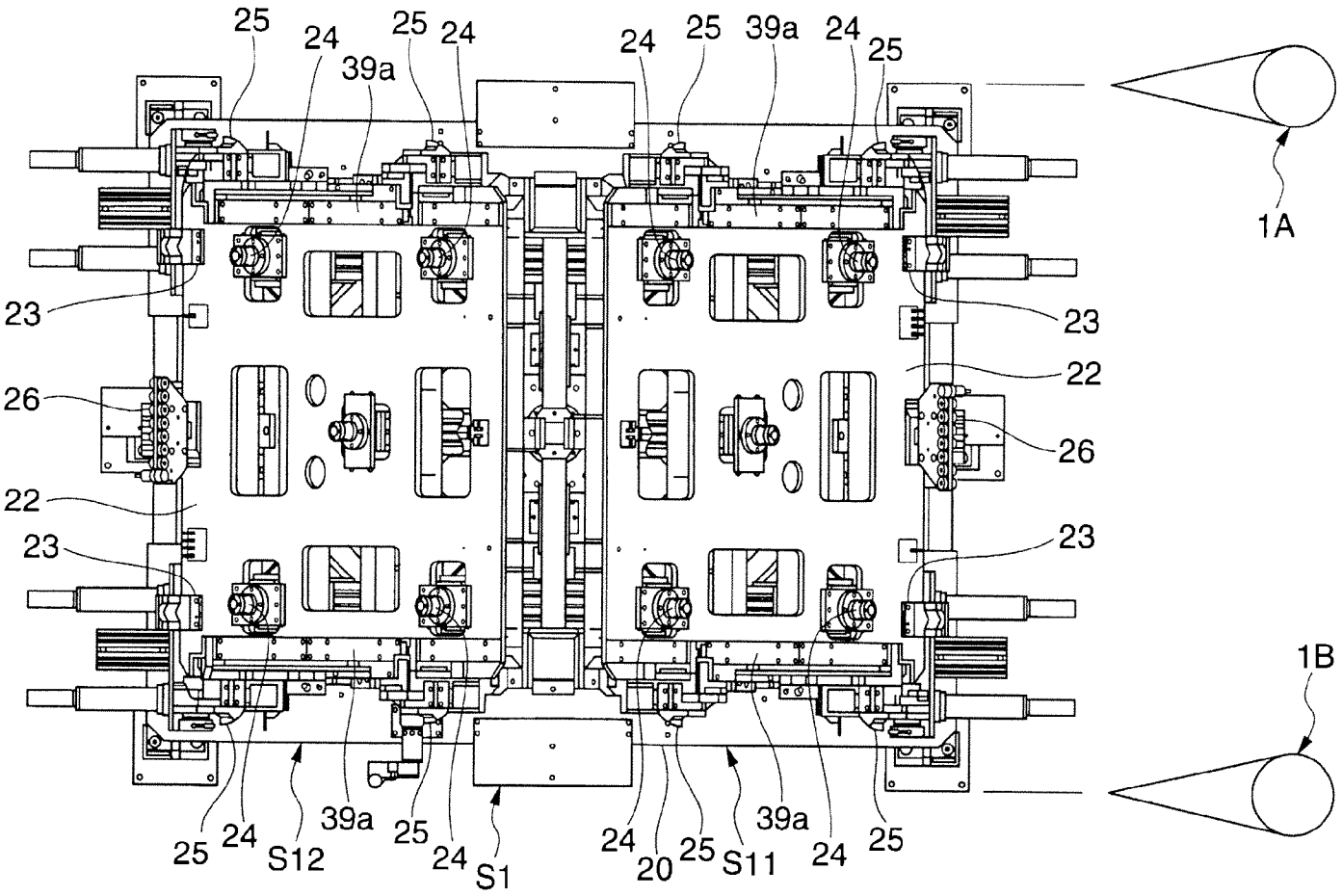
FIG. 6 is an explanatory plan view of FIG. 5.
Figure 7:
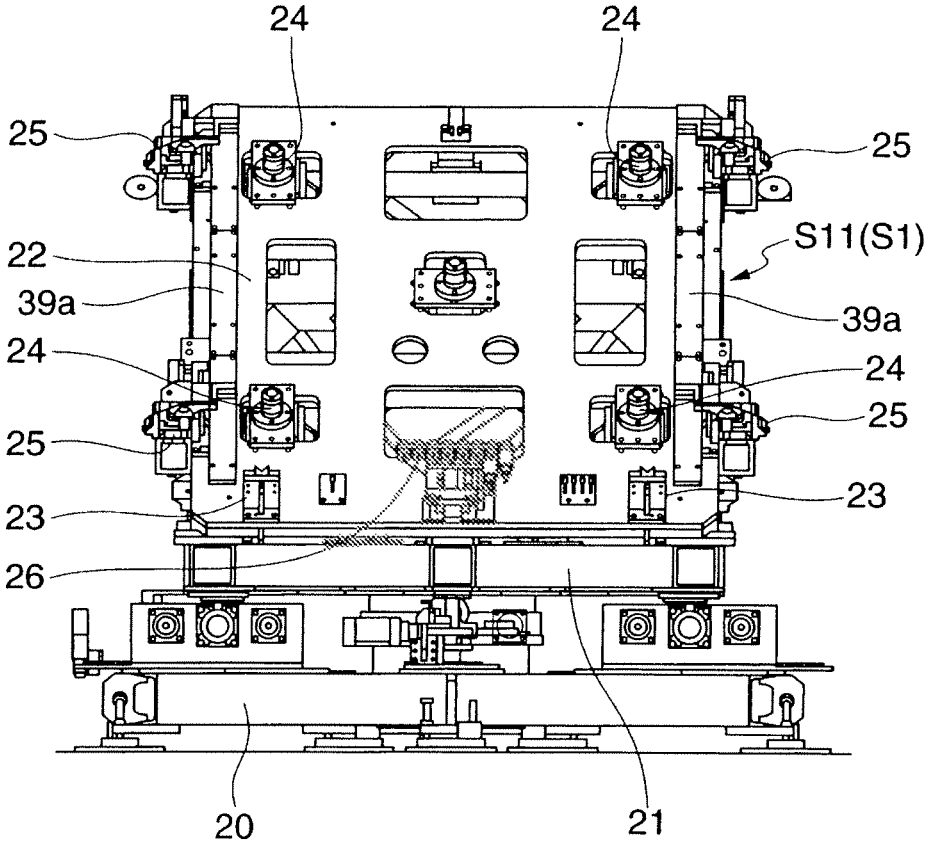
FIG. 7 is an explanatory right side view of FIG. 5.

FIGS. 5-7 show the details of the clamping jigs 22 on the hemming processing stage S1 which is one of the hemming processing stages S1 and S2 described before. Besides, the clamping jig 22 of the another hemming processing stage S2 is merely different in the direction from the clamping jig 22 on the hemming processing stage S1, and the structure of the clamping jig 22 of the another hemming processing stage S2 is identical to that of the clamping jigs 22 of the hemming processing stage S1.

FIG. 5 shows a front view of the clamping jig 22. FIG. 6 shows a plan view of FIG. 5. FIG. 7 shows a right side view of FIG. 5. As shown in these drawings, the horizontal turn table 21 is disposed on a base 20 of the hemming processing stage S1. This turn table 21 can be rotated to be indexed about a vertical axis at each 180 degrees by an activation of a rotation driving mechanism (not shown). Moreover, the pair of the two substantially rectangular clamping jigs 22 are disposed on the turn table 21 in the rotational symmetry to stand back to back in the backward tilting posture. Furthermore, the hemming die 27 shown in FIG. 8 is removably positioned and fixed on the each of the clamping jigs 22 in the backward tilting posture.

As described above, the pair of the two clamping jigs 22 are capable of being rotated and indexed with the turn table 21 at each 180 degrees. When one of the clamping jigs 22 is indexed to the sub stage S11 confronting the pair of the hemming processing robots 1A and 1B shown in FIG. 6, the other of the clamping jigs 22 is indexed to the sub stage S12. As described above, the sub stage S11 has a function as the actual processing stage on which the hemming processing is actually performed. The sub stage S12 has a function of setting and unloading of the workpiece, and changing the hemming dies (tooling change). With this, the hemming processing robots 1A and 1B perform the hemming processing on the sub stage S11. On the other hand, the changing operation of the hemming dies 27 is performed on the sub stage S12, as described above.

Figure 8:
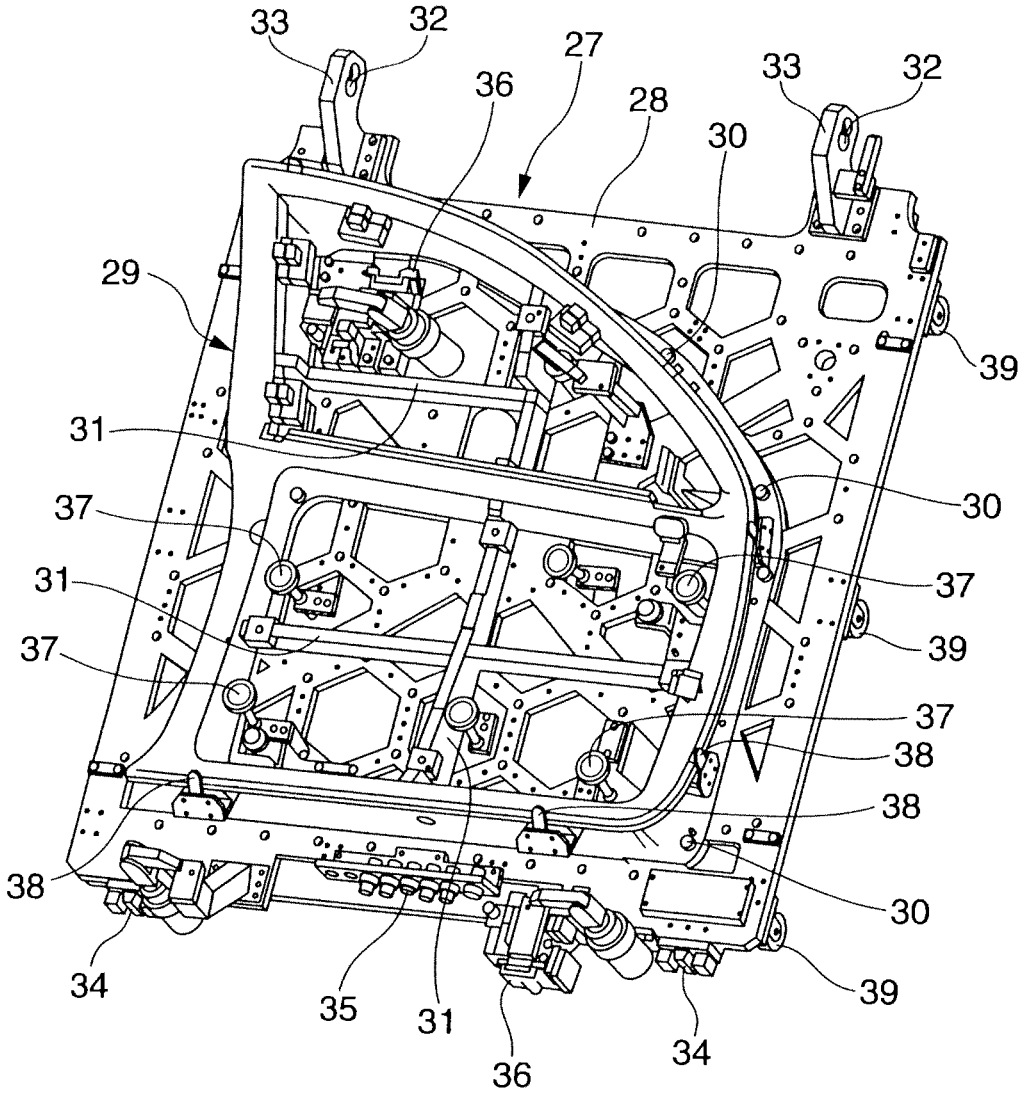
FIG. 8 is a perspective view showing details of the hemming die.

As shown in FIGS. 5-7, the clamping jig 22 to which the hemming die 27 is removably positioned and fixed in the backward tilting posture is provided with positioning blocks 23 which are references for positioning of the hemming die 27 shown in FIG. 8, a plurality of locating devices 24, a plurality of clamping devices 25, and a coupler (quick joint) 26. Moreover, the clamping jig 22 is provided, on the both side portions, with plate-shaped guide ways 39*a* on which the guide rollers 39 (cf. FIG. 8) of the hemming die 27 described later are abutted and rolled when the hemming die 27 is loaded, positioned and fixed to the clamping jig 22 in the backward tilting posture. These guide ways 39*a* serve as guide portions to restrict the posture of the hemming die 27 loaded to the clamping jig 22.

On the other hand, FIG. 8 shows the details of the hemming die 27 removably positioned and fixed to the clamping jig 22. The hemming die 27 shown in FIG. 8 is constituted by removably positioning and fixing a die body 29 on a surface of the plate-shaped rectangular die plate 28 for the reinforcement, by bolts/nuts 30. As shown in this drawing, the hemming die 27 is removably mounted in the backward tilting posture on the clamping jig 22 shown in FIGS. 5-7.

The die bodies 29 have slightly different shapes and specifications according to the types of the vehicle of the door panels to which the hemming processing is performed. On the other hand, a common member is used as the die plate 28 itself, irrespective of the differences of the die bodies 29 according to the types of the vehicle. The weights of the hemming dies 27 are decreased since the hemming dies 27 are positively changed between the hemming processing stages S1 and S2 and the die storage devices 15A and 15B by the first and second die changing robots 17 and 19, as described above. In particular, the die plate 28 employs a plate shape with a plurality of holes, as shown in FIG. 8. On the other hand, the die body 29 employs a closed-loop shape, that is, a hollow frame shape in which the periphery portion directly relating to the hemming processing is remained. Moreover, the hollow portion is appropriately reinforced by a bar-shaped reinforcement member 31.

A pair of hook portions 33 each having a hole 32 is formed at an upper end of the die plate 28 shown in FIG. 8 on the surface of the die plate 28 on which the die body 29 is fixed in consideration of the portability by the first and second die changing robots 17 and 19 described above. On the other hand, locating blocks 34 which are arranged to be fitted by the raised and recessed portions with the positioning blocks 23 of the clamping jig 22 shown in FIGS. 5-7 are provided at the lower end of the die plate 28. Similarly, a coupler 35 which is fitted with the coupler 26 of the clamping jig 22 is provided at the lower end of the die plate 28. Moreover, the die plate 28 is equipped with a plurality of clamping devices 36 which draw the door panel assembly that is an object to which the hemming processing is performed and also the hand 11 described above, and which positions and fixes those on the die body 29, and a plurality of vacuum cups 37 which similarly draw the door panel assembly that is the object to which the hemming processing is performed, in the die body 29 by the negative pressure suction so as to position that. Moreover, a plurality of claw portions 38 are provided around the die body 29. The die body 29 is provided, on the periphery, with claw portions 38 arranged to position the periphery portion of the door outer panel with respect to the die body 29.

Accordingly, when the hemming die 27 is mounted on the clamping jig 22 of FIGS. 5-7, the hemming die 27 and the clamping jig 22 are relatively positioned by the fitting of the recessed and raised portions of the positioning blocks 23 and the locating blocks 34, and the couplers 26 and 35 of the clamping jig 22 and the hemming die 27 are fitted with each other. By the fitting of the couplers 26 and 35, it is possible to supply the actuation air pressure from the clamping jig 22 to the clamping devices 36 and the vacuum cups 37 of the hemming die 27. Then, the hemming die 27 is firmly positioned and clamped by the clamp devices 25 and the locating devices 24 of the clamping jig 22.

On the other hand, when the door panel assembly and also the hand 11 are loaded to the hemming die 27 positioned and fixed to the clamping jig 22 as described above, those are positioned by the plurality of the claw portions 38, and then firmly fixed by the clamping devices 36 and the vacuum cups 37.

Besides, a plurality of guide rollers 39 are mounted on the back surface of the die plate 28 in consideration of the operation of loading and unloading the hemming die 27 to and from the clamping jig 22 or the die storage devices 15A and 15B. Accordingly, when the hemming die 27 is loaded to the clamping jig 22, the guide rollers 39 of the die plate 28 are abutted and rolled on the guide ways 39*a* of the clamping jig 22. However, the positioning and clamping of the hemming die 27 with respect to the clamping jig 22 is performed by the clamping devices 25 and the locating devices 24 described above. Accordingly, the final accuracy of the positioning of the hemming die 27 is not affected by the abutment state of the guide rollers 39 and the guide ways 39*a*.

In this way, on the sub stages S11 of the hemming processing stages S1 and S2, the hemming processing robots 1A and 1B or 2A and 2B perform the hemming processing while the clamping jig 22, the hemming die 27, and also the door panel assembly are remained in the backward tilting posture. The arms of the hemming processing robots 1A and 1B or 2A and 2B are not forced into the constrained posture. Accordingly, it is possible to largely ensure the degree of the freedom of the locus, and to perform the stable processing.

Figure 9:
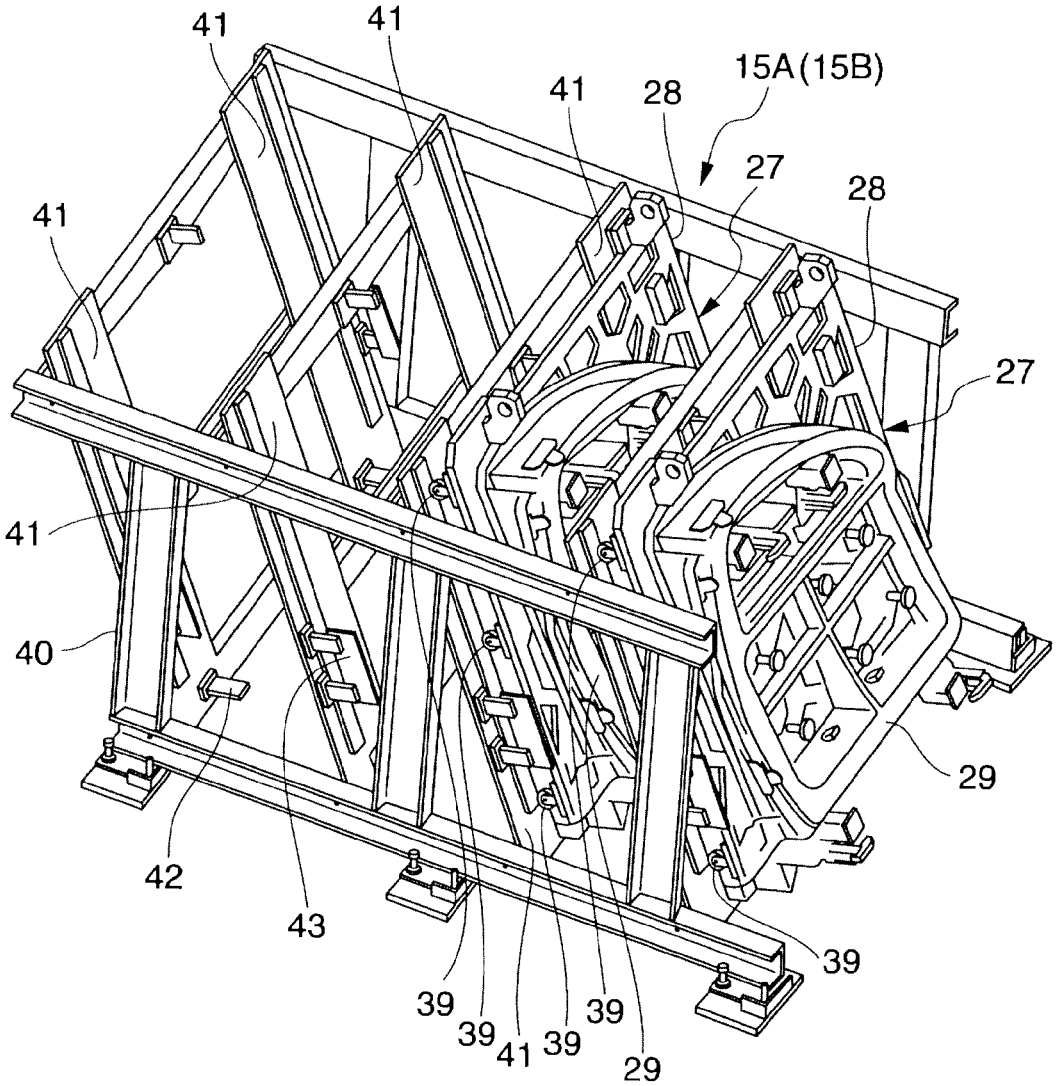
FIG. 9 is a perspective view showing a main part of a die storage device in which the hemming die of FIG. 8 is stored.

FIG. 9 shows details of main parts of the die storage devices 15A and 15B shown in FIG. 1. As shown in this drawing, the die storage devices 15A and 15B installed on the floor are for receiving the plurality of the hemming dies 27 shown in FIG. 8 in the longitudinal posture, more specifically, for receiving those in a line in the backward tilting posture in the multiple rows. A plurality pairs of left and right sheet plates 41 for supporting the hemming dies 27 in the backward tilting posture are obliquely disposed on a frame-shaped rack 40.

In this case, as described above, the die bodies 29 constituting the respective hemming dies 27 have the different shapes according to the types of the vehicle of the door panel assembly that is the object to which the hemming processing is performed. On the other hand, the one common member is employed as the die plate 28, irrespective of the differences of the die bodies 29 according to the types of the vehicle. With this, it is possible to simplify the structures of the die storage devices 15A and 15B itself, and to facilitate to store and regulate the hemming dies 27 in the die storage devices 15A and 15B. Moreover, it is possible to reuse the die plates 28 itself in a case where the hemming die 27 is largely varied at the model change and so on, and to reduce the facility cost.

Moreover, each of the sheet plates 41 in the tilting posture is provided with a positioning block 42 identical to the reference blocks 23 of the clamping jig 22 of FIGS. 5-7, and also a side guide plate 43. Accordingly, the plurality of the hemming dies 27 are received in an orderly manner in the line on the sheet plates 41 of the rack 40 in the backward tilting posture similarly to when the hemming dies 27 are mounted on the clamping jigs 22 of FIGS. 5-7, so as not to interfere with each other. At the same time, the existence and the non-existence of the hemming dies 27 are detected and regulated by a sensor (not shown).

Besides, when the hemming dies 27 are loaded to the racks 40 of the die storage devices 15A and 15B, the guide rollers 39 on the back surface of the die plate 28 of the hemming die 27 shown in FIG. 8 are abutted and rolled on the sheet plates 41. Accordingly, each of the sheet plates 41 serves as a guide portion to restrict the posture of the hemming die 27 loaded to the die storage devices 15A and 15B.

In this way, by the die storage devices 15A and 15B which receive, within racks 40, the plurality of the hemming dies 27 in the multiple rows in the backward tilting posture, it needs less occupied space relative to a case in which the hemming dies 27 are stored in the horizontal posture (horizontal mount), and it is superior in the space efficiency.

Figure 11:
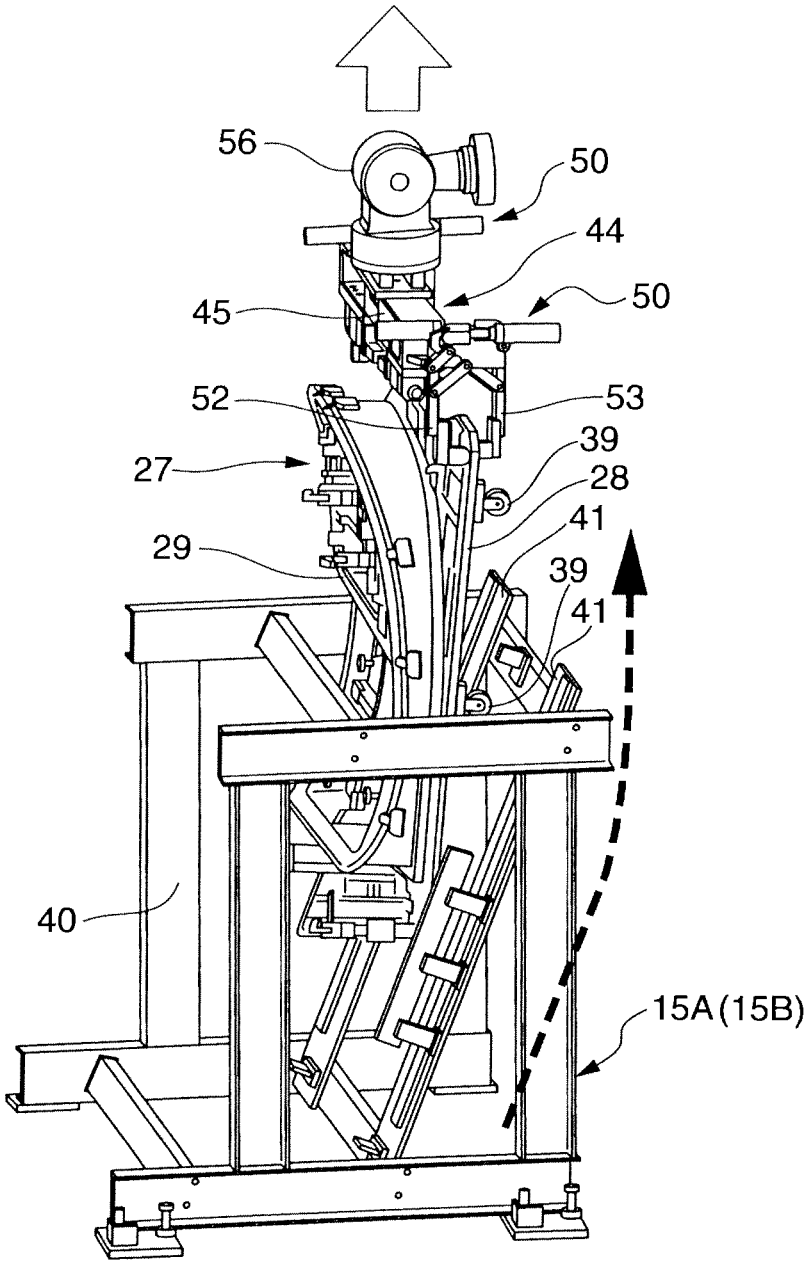
FIG. 11 is a perspective view showing a state in which the hemming die is hung and raised from the die storage device of FIG. 9 by the die changing hand of FIG. 10.

In a case where the respective hemming dies 27 are stored in the die storage devices 15A and 15B in the longitudinal posture which is in the upright posture as shown in FIG. 11 as described later, it is possible to further decrease the occupied space. However, in this case, it is necessary to support the respective hemming dies 27 from the front and back surfaces for preventing the falling of each of the hemming dies 27. Accordingly, it is desirable that the hemming dies 27 are stored in the backward tilting posture shown in FIG. 9 in consideration of the simplification of the structure of the entire die storage devices 15A and 15B.

On the other hand, FIG. 10 shows details of the die changing hand 44 of the first and second die changing robots 17 and 19 arranged to change the hemming dies 27 between the hemming processing stages S1 and S2 and the die storage devices 15A and 15B shown in FIG. 1. As shown in this drawing, a frame 45 of the die changing hand 44 connected to a wrist portion 56 of each of the first and second die changing robots 17 and 19 is provided with a pair of left and right hanging blocks 47 each having a slot 46 which is capable of receiving the hook portion 33 of the die plate 28 shown in FIG. 8. In this hanging block 47, a slidable support shaft 48 is disposed. The support shaft 48 is arranged to be slid. The support shaft 48 extends in the bridge formation manner between the both end sides of the slot 46 to sandwich the slot 46. This support shaft 48 is slidably driven (moved in a forward direction and in a rearward direction, or moved into and out of) by a direct operated air cylinder 49.

Accordingly, when once the support shaft 48 is moved in the rearward direction and the support shaft 48 is again moved in the forward direction while the hook portion 33 of the die plate 28 shown in FIG. 8 is inserted into the slot 46 of the hanging block 47, the support shaft 48 is inserted into the hole 32 of the hook portion 33, so that the frame 45 of the die changing hand 44 and the die plate 28 of the hemming die 27 are connected with each other. With this, as shown in FIG. 11, it is possible to hang and raise the hemming die 27 in the upright posture by the gravity by the die changing hand 44 by using the hook portion 33 of the die plate 28 as a grasping portion.

Besides, in this case, the support shaft 48 merely penetrates through the hole 32 of the hook portion 33 of the die plate 28. Accordingly, that hemming die 27 is allowed to gradually vary its posture to the upright posture by its own weight at the hanging and raising process of the hemming die 27 by using the hook portion 33 as the grasping portion. With this, it is unnecessary to largely vary the entire posture of the hemming die 27 when the hemming die 27 is transferred to the clamping jig 22 and so on. It is possible to simplify the movements of the first and second die changing robots 17 and 19, and to decrease the working hours.

In this case, as shown in FIG. 11, in a case where the first die changing robot 17 or the second die changing robot 19 conveys the hemming die 27 to the predetermined position while the hemming die 27 is hung and raised by the die changing hand 44 in the upright posture by its own weight, there is a worry that the hemming die 27 may be swung by the inertia force. Therefore, the frame 45 of the die changing hand 44 is provided with anti-vibration devices 50 which are for the hemming die 27, and which are disposed at both ends of the frame 45 in the longitudinal direction This anti-vibration device 50 operates to open and close (pivot) a pair of long and short swing arms 52 and 53 each having a pad 51 located at a tip end thereof, by swing type air cylinders 54 and 55. Then, when the hemming die 27 is hung and raised in the upright posture by its own weight as shown in FIG. 11 and the swing arms 52 and 53 of the anti-vibration device 50 are operated to be pivoted in the closing direction, the pads 51 of the swing arms 52 and 53 are abutted on the both front and back surfaces of the upper end portion of the die plate 28. With this, it is possible to prevent the useless swing movement of the hemming die 27 when the hemming die 27 is hung, raised, and moved by the die changing hand 44. Consequently, it is possible to smoothly convey the hemming die 27 which is a heavy member by the robot operation.

Moreover, when the hemming die 11 hung and raised by the die changing hand 44 is returned to the die storage devices 15A and 15B by the operation opposite to the operation in FIG. 11, each of the swing arms 52 and 53 of the above-described anti-vibration device 50 is operated to open before the hemming die 27 lands on the sheet plates 41. With this, it is possible to solve the troubles when the hemming die 27 is transferred to the die storage device 15A or 15B in the backward tilting posture by the die changing hand 44.

Moreover, as shown in FIG. 8, the hook portions 33 provided on the die plate 28 of the hemming die 27 are located on the surface identical to the surface of the die plate 28 on which the die body 29 is fixed, so that the holes 32 of the hook portions 33 are substantially offset to the surface's side of the die plate 28. Therefore, it is advantageous when the hemming die 27 is hung and raised in the upright posture by the die changing hand 44 by using the hook portions 33 as the grasping portion, or when that hemming die 27 hung and raised is loaded in the backward tilting posture to the clamping jig 22 or the die storage devices 15A and 15B. The hemming die 27 does not become the forward tilting posture.

In this way, in this embodiment, the changing operation of the hemming dies 27 according to the change of the type of the vehicle of the door panel that is the object to which the hemming processing is performed is performed by the first and second die changing robots 17 and 19 by passing through the temporarily mounting table 18 between the hemming processing stages S1 and S2 and the die storage devices 15A and 15B. Accordingly, it is reasonably and flexibly respond even in high-variety low-volume manufacturing in which the kind of the door panel of the object to which the hemming processing is performed are further increased, and to improve the productivity.

Moreover, when the hemming die 27 is changed between the hemming processing stages S1 and S2 and the die storage devices 15A and 15B, the temporary transfer of the hemming die 27 to the temporarily mounting table 18, and the indexing operation in the hemming processing stages S1 and S2 which uses the turn table 21 as the main part are shared. With this, it is possible to effectively perform the changing operation of the hemming die 27, and to reduce the loss time.

In particular, the hemming dies 27 for the plurality of the types of the vehicle are received in the die storage devices 15A and 15B in a line in the backward tilting posture. With this, the occupied space for storing the hemming dies 27 is small with respect to the number of the stored hemming dies 27. It is remarkably superior in the space efficiency.

The invention claimed is:

1. A roller hemming processing system in which used hemming dies can be changed in accordance with a type of a workpiece when a hemming processing is performed on a peripheral portion of the workpiece by a roller-shaped hemming processing tool which is held by a robot arm while the workpiece that is a processed object is positioned and supported on one of the hemming dies, the roller hemming processing system comprising:

the hemming dies each including a die body mounted on a die plate for reinforcement, a clamping jig which is disposed on a hemming processing stage, and which is capable of removably positioning and fixing one of the hemming dies;

a die storage device in which a plurality of the hemming dies according to the type of the workpiece are received in a line in a longitudinal posture;

a die changing robot which changes one of the hemming dies between the clamping jig and the die storage device by grasping one of the hemming dies to swing one of the hemming dies; and guide portions which are provided, respectively, to the clamping jig and the die storage device, and which restrict a posture of the hemming die loaded to the clamping jig or the die storage device, wherein a hook portion is provided on one side portion of the die plate; a hand of the die changing robot configured to use the hook portion as a grasping portion; and the hand of the die changing robot supports the hemming die in a hanging position in an upright posture, and wherein the plurality of the hemming dies according to the type of the workpiece are received in the die storage device in the line in a tilting posture in which the hemming dies are tilted in the same direction, and wherein a roller is provided on a back surface of the die plate.

2. The roller hemming processing system as claimed in claim 1, wherein the plurality of the hemming dies according to the type of the workpiece are received in the die storage device in the line in the tilting posture in which the die body is positioned above the die plate.

3. The roller hemming processing system as claimed in claim 2, wherein the clamping jig is arranged to removably position and fix one of the hemming dies in the tilting posture.

4. The roller hemming processing system as claimed in claim 3, wherein the die bodies constituting the hemming dies with the die plates are different from each other in accordance with the type of the workpiece; the die plates have a common shape irrespective of the type of the workpiece, and have a rectangular plate shape with a plurality of holes; and the die body according to the type of the workpiece is removably fixed to the die plate by bolts and nuts.

5. The roller hemming processing system as claimed in claim 4, wherein the die body has a hollow structure in which at least a portion corresponding to a hemming processing portion of the workpiece remains in the form of a closed loop frame.

6. The roller hemming processing system as claimed in claim 1, wherein the hand of the die changing robot includes an anti-vibration device to suppress a swing movement of the hemming die supported to be hung up in the upright posture.

7. The roller hemming processing system as claimed in claim 6, wherein a temporary mounting table is disposed between the clamping jig of the hemming processing stage and the die storage device; the roller hemming processing system further comprises a first die changing robot configured to change the hemming die between the temporary mounting table and the die storage device, and a second die changing robot configured to change the hemming die between the temporary mounting table and the clamping jig; and the first die changing robot and the second die changing robot are operated independently.

8. The roller hemming processing system as claimed in claim 7, wherein a turn table is disposed in the hemming processing stage; the clamping jig is a first clamping jig; the roller hemming processing system further comprises a second clamping jig which is disposed on the hemming processing stage, and which is capable of removably positioning and fixing one of the hemming dies, a pair of the first clamping jig and the second clamping jig are mounted on the turn table in a rotational symmetry in the tilting posture; and the turn table is configured to index the respective clamping jigs to a hemming processing position in accordance with a rotation operation of the turn table.

9. The roller hemming processing system as claimed in claim 8, wherein the hook portion is provided on a surface side of the die plate on which the die body is mounted.

10. The roller hemming processing system as claimed in claim 9, wherein the die storage device is provided with a plurality of sheet plates which serve as the guide portion, which support the hemming die received in the line in the die storage device, and which are provided in the tilting posture.

11. The roller hemming processing system as claimed in claim 10, wherein the roller on the back surface of the die plate of the hemming die is abutted on the sheet plate when the hemming die is received in the line in the die storage device.

12. The roller hemming processing system as claimed in claim 11, wherein the clamping jig is provided with a plurality of guide ways serving as the guide portion, and supporting the hemming die loaded to the clamping jig.

13. The roller hemming processing system as claimed in claim 12, wherein the roller on the back surface of the die plate of the hemming die is abutted on the guide ways when the hemming die is loaded to the clamping jig.

14. The roller hemming processing system as claimed in claim 1, wherein the plurality of the hemming dies according to the type of the workpiece are received in the die storage device in the line in the tilting posture in which the hemming dies are tilted in the same direction so that the hook portions of the die plates are positioned at the same height position.

* * * * *